US005777257A

United States Patent [19]

Kenny

[11] Patent Number: 5,777,257

[45] Date of Patent: Jul. 7, 1998

[54] SHAPED CHARGE ASSEMBLY WITH TRUNCATED LINER

[75] Inventor: John J. Kenny, Marrero, La.

[73] Assignee: Senior Power Services, Inc., Demex Division, Lyman, S.C.

[21] Appl. No.: 818,336

[22] Filed: Mar. 14, 1997

[51] Int. Cl.[6] ..... F42B 3/00; F42D 3/00

[52] U.S. Cl. ..... 102/312; 102/313; 102/307; 175/4.52; 175/4.6

[58] Field of Search ..... 102/306, 307, 102/312, 313; 175/4.51, 4.52, 4.6

[56] References Cited

U.S. PATENT DOCUMENTS

| | | | |
|---|---|---|---|
| 3,119,332 | 1/1964 | Grebe et al. | 102/313 X |
| 4,724,105 | 2/1988 | Owen | 264/3.1 |
| 4,787,315 | 11/1988 | Kenny | 102/313 |
| 4,862,964 | 9/1989 | George et al. | 166/297 |
| 5,177,321 | 1/1993 | Kenny | 102/312 |
| 5,211,224 | 5/1993 | Bouldin | 166/63 |
| 5,429,192 | 7/1995 | Huber et al. | 166/297 |
| 5,513,570 | 5/1996 | Mulcahy | 102/313 |

*Primary Examiner*—Peter A. Nelson
*Attorney, Agent, or Firm*—Keaty & Keaty

[57] ABSTRACT

The invention relates to an explosive charge assembly for cutting tubular members, particularly underwater. The assembly is lowered into the tubular member to a distance where the cut is to be performed. A shaped charge carrier has a pair of parallel circular plates, a casing unitary connected to the plates and a truncated shaped charge liner. An inflatable bladder surrounding the casing expands to create a stand off distance between the wall of the tubular member and the shell of the assembly. A plurality of centralizer members allow to adjust position of the shell in the tubular member prior to detonation.

20 Claims, 3 Drawing Sheets

SHAPED CHARGE ASSEMBLY WITH TRUNCATED LINER

BACKGROUND OF THE INVENTION

The invention relates to an explosive industry, and more particularly to a device for severing underwater structures having cylindrical openings.

Offshore platforms are traditionally used for conducting oil and gas exploration and production operations in shallow and deep waters a distance from the coast line. Many offshore platforms are designed to be supported by legs imbedded into the ocean floor a certain depth below a mudline. After the operation of the platform at a particular location is no longer beneficial, the platform is often times removed and towed to another location where it is repositioned for a new exploration or production operation.

The task of removal of the platform includes a step of eliminating all underwater structures, pipelines and manifolds which have been in use during the platform's operation. Under the current federal regulations, a jacket and a leg pile that supports the platform has to be cut below a mudline, so as to restore, as close as possible, the natural habitat for marine life and ensure safety of the environment.

Various methods have been used for severing tubular members below a mudline. Most efficient of these methods involves the use of shaped charges for precise severing of the tubular members at the desired distance below the mudline. Conventionally, shaped charges have a chevron shape, that is a V-shaped cross section, with the wider opening directed toward the wall of the tubular member that needs to be severed. An explosive material is fitted between the walls of the shaped charge casing and a liner, and then detonated from the surface, causing the liner to explode and move in a focused jet toward the wall of the tubular member. The created jet cuts through the wall of the structure, creating a clean cut and allowing removal of the upper portion of the tubular member, while leaving the lowermost part buried at the required depth below the mudline.

However, the chevron-shaped charges require a relatively large amount of an explosive material. Additionally, the two plates, or wafers, between which the explosive charge is positioned are relatively thick, which increases the weight of the shaped charge device lowered into the tubular member.

The present invention contemplates elimination of drawbacks associated with the prior art and provision of an improved shaped charge apparatus for severing tubular members.

SUMMARY OF THE INVENTION

It is, therefore, an object of the present invention to provide an improved shaped charge apparatus for severing tubular members.

Another object of the present invention is to provide a shaped charge apparatus having a truncated liner that covers and protects an explosive material positioned in the shaped charge casing.

It is a further object of the present invention to provide an improved shape charge apparatus which requires less explosive material for creating an explosive force suitable for severing a tubular member under water.

It is still a further object of the present invention to provide a shaped charge apparatus utilizing reduced weight plates, or wafers, in order to more efficiently lower the shaped charge apparatus into a tubular member.

These and other objects of the present invention are achieved through a provision of an apparatus for severing tubular members, particularly tubular members underwater, which comprises an outer shell that can be lowered into the tubular member to a desired depth where the cut is to be performed. The shell houses an explosive charge carrier which comprises a pair of parallel circular plates, a shaped charge casing unitary connected to the plates and a shaped charge liner secured to the casing and extending a distance therefrom. A chamber formed between the inner wall of the liner and outer wall of the casing communicates with a channel formed between the parallel plates.

An explosive material is positioned in the channel between the plates and in the chamber behind the liner. A central detonation plug is secured to an upper plate and houses a detonating cord connected to an above-the-water detonation control device or a wireline detonator. When a signal is sent by the control device, it is transmitted radially from the central detonating cord to the shaped charge positioned in the casing.

The liner has a truncated cross section and is comprised of an inner wall oriented in a transverse relationship to the parallel plates and a pair of side walls. Each of the side walls is unitary connected to the inner wall of the liner and extends outwardly at an obtuse angle therefrom.

A resilient inflatable bladder is secured to a frame attached to the shaped charge carrier for forming a necessary stand off distance between an inner wall of the tubular member and the liner. The stand off distance is created when a pressurized gas is delivered to the space between the liner and the inflatable bladder, facilitating formation of a focused jet for cutting the tubular member.

A plurality of normally retracted centralizer members carried by the frame are adapted for extending outwardly from the shell of the assembly, into frictional contact with the inner wall of the tubular member in order to centralize position of the shaped charge assembly prior to detonation. A pressurized gas is delivered to centralizer housings, where the centralizer members are telescopically engaged, forcing the centralizer members to extend outwardly into a contact with the inner wall of the tubular member.

The truncated liner allows to use much less explosive material than is normally required for severing a particular tubular member of a defined thickness. Additionally, the plates or wafers which form a part of the shaped charge are made thinner, have a substantially lower weight than conventional explosive devices which allows to increase efficiency of the shaped charge explosive assembly in operation.

BRIEF DESCRIPTION OF THE DRAWINGS

Reference will now be made to the drawings, wherein like parts are designated by like numerals, and wherein.

DETAIL DESCRIPTION OF THE PREFERRED EMBODIMENT

Figure 1:
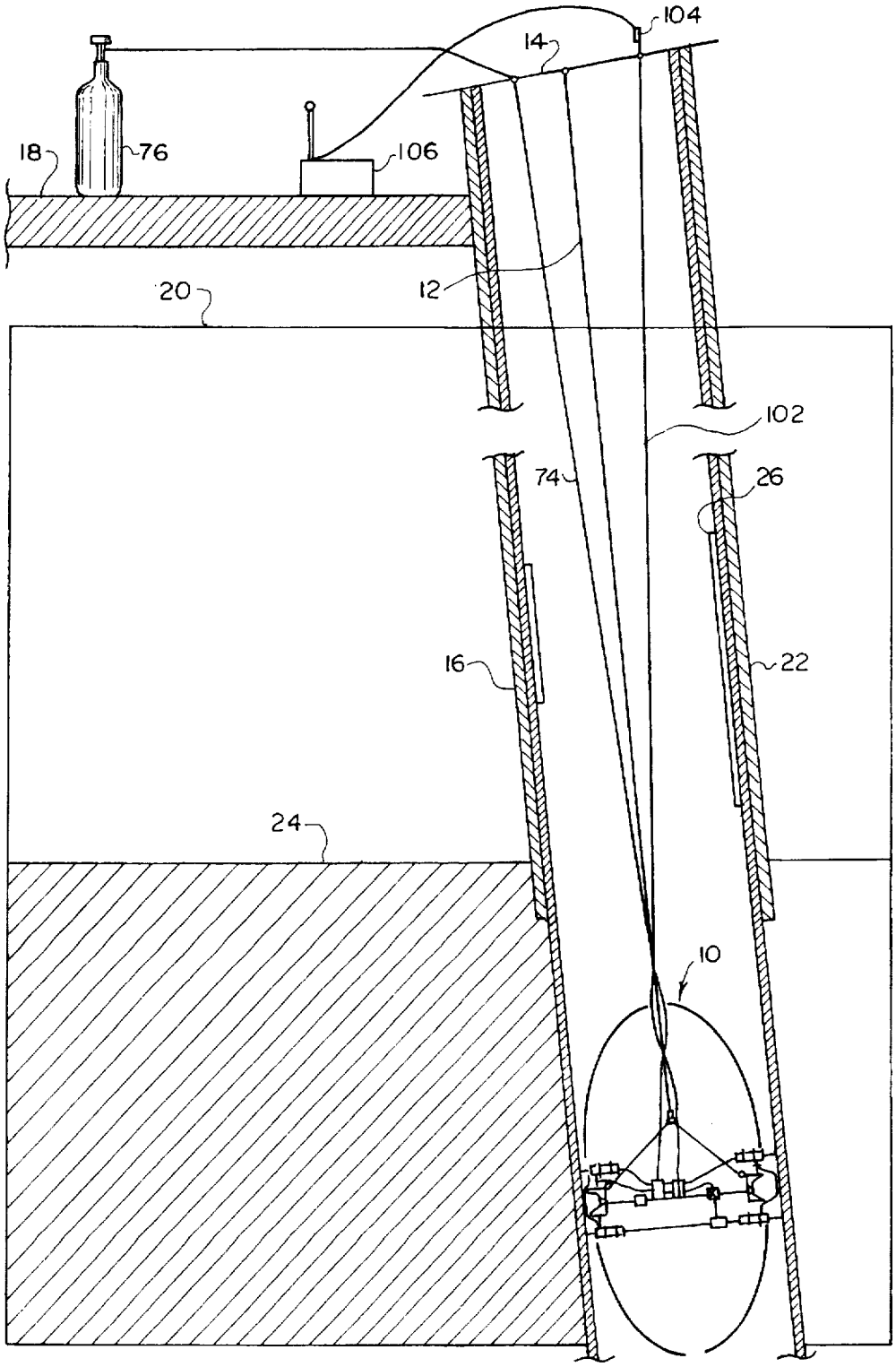
FIG. 1 is a schematic view of the apparatus in accordance with the present invention lowered into a tubular member to a desired depth.

Turning now to the drawings in more detail, numeral 10 designates the shaped charge assembly in accordance with the present invention. As shown in FIG. 1, the assembly 10 is suspended by a cable secured to a cross plate, or bar 14. The bar 14 rests on a top edge of a tubular member. In the application shown in FIG. 1, the tubular member is a typical leg platform pile 16 extending from a deck 18 of a platform floating above a waterline 20. The cross bar, or plate 14 can be positioned at 12–17 feet above the waterline, or at other convenient height above the deck 18.

The pile 16 is surrounded, for some length, by a leg jacket 22 that extends, some distance, below a mudline 24, while the pile 16 extends still further below the mudline 24 to a depth exceeding 14–16 feet. Conventionally, a stabbing guide 26 is secured on the interior of the pile 16, as shown in FIG. 1.

Figure 2:
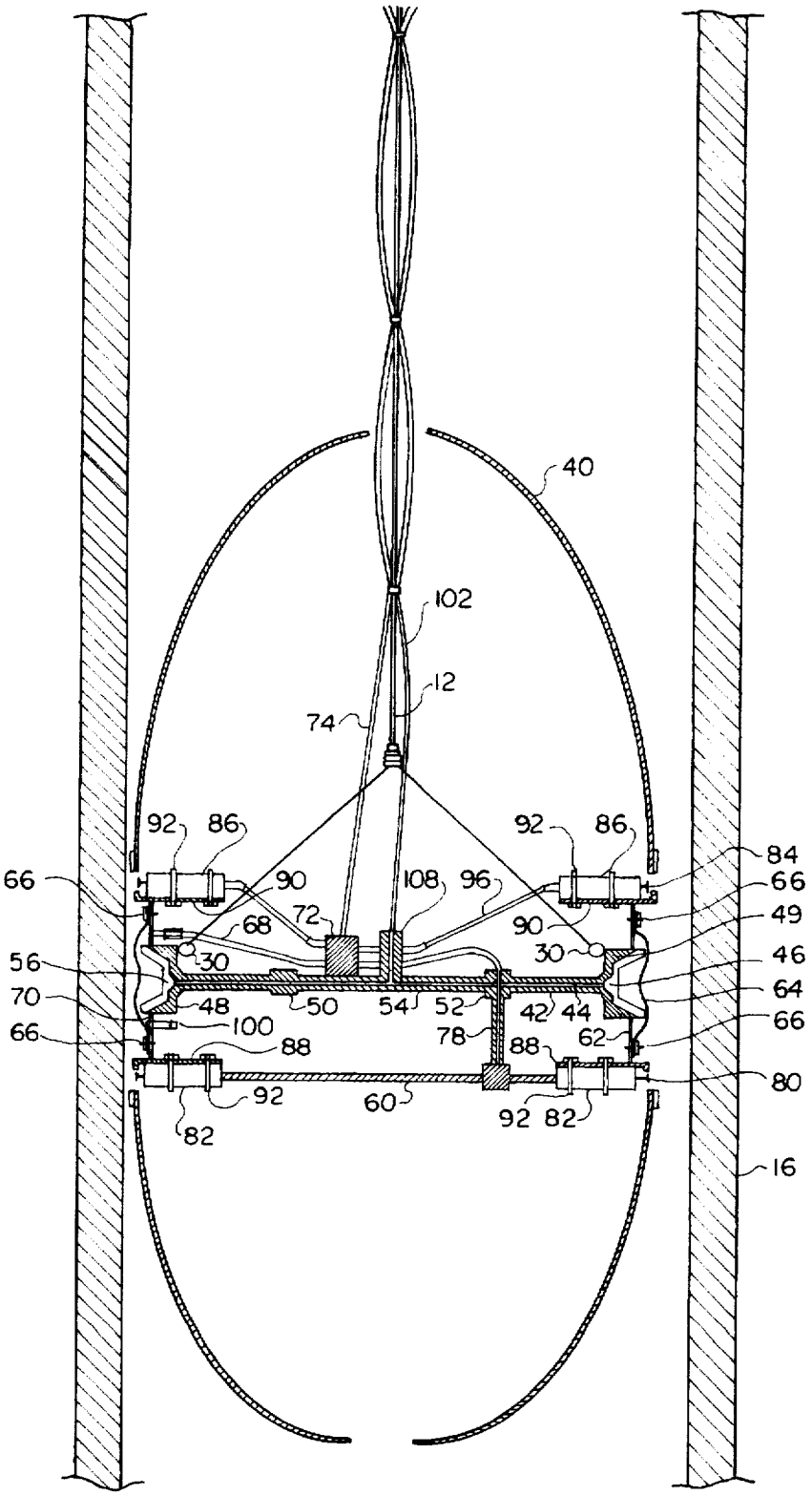
FIG. 2 is a cross sectional view of the apparatus in accordance with the present invention lowered into a tubular member, with centralizers in a retracted position.
Figure 3:
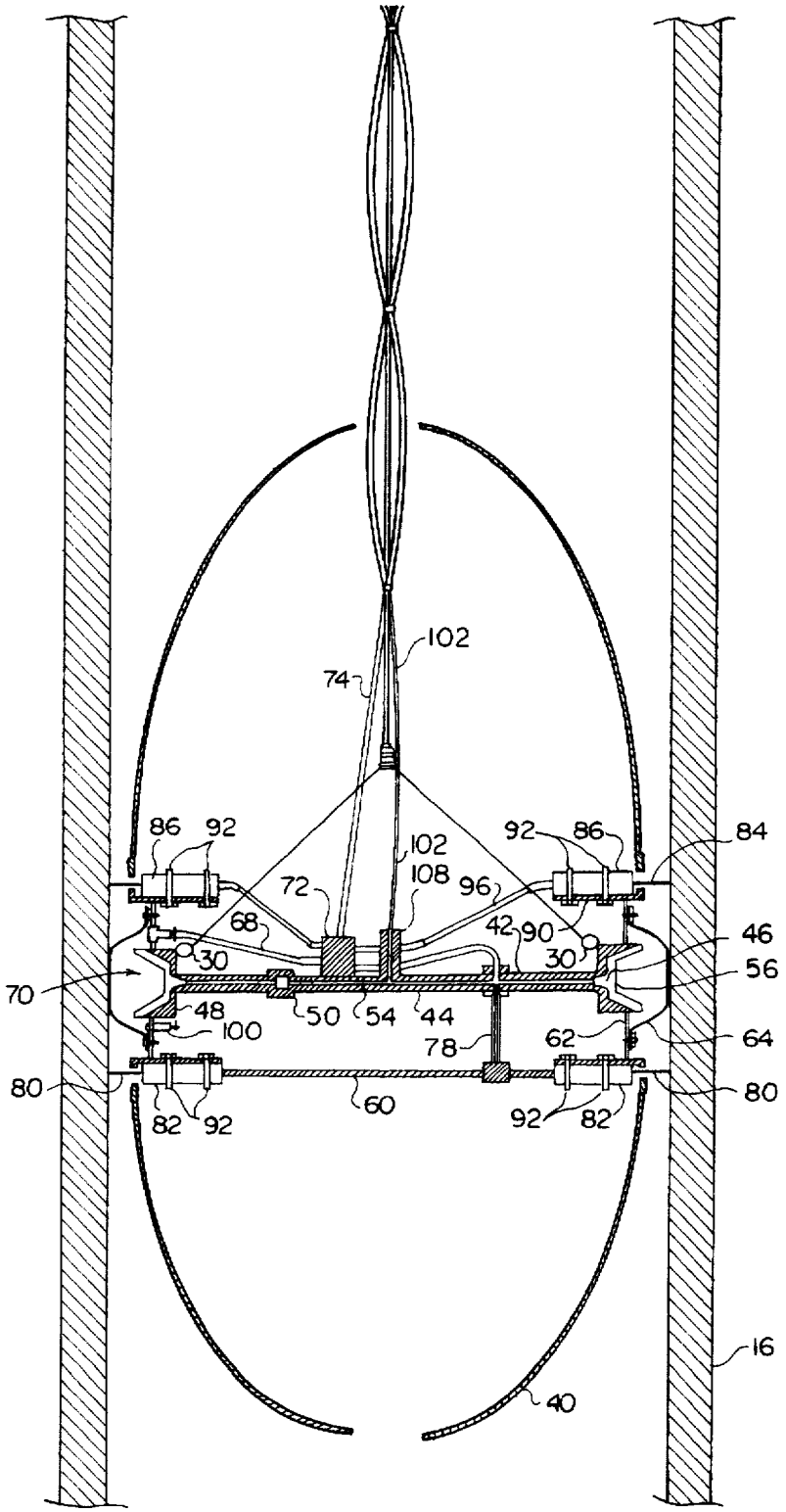
FIG. 3 is a cross sectional view of the apparatus in accordance with the present invention with the centralizers in an extended position inside a tubular member.

The suspension cable 12 carries the explosive shaped charge apparatus on its lower end, through engagement with a plurality of padeyes 30 spaced equidistantly about the circumference of the shaped charge housing (see FIGS. 2 and 3). In the preferred embodiment, the number of padeyes 30 can be three or more in number so as to allow equidistant positioning of the padeyes and secure suspension of the assembly 10 during operation.

Turning now to FIGS. 2 and 3, the shaped charge apparatus of the present invention is shown to comprise a shell, or housing 40 which can be oval, or egg shaped to facilitate lowering of the shaped charge into the tubular member. Mounted in the shell 40 is a shaped charge carrier which comprises an upper plate, or wafer 42, a lower plate, or wafer 44, a truncated shaped charge liner 46, and casing 48. The upper wafer 42 and the lower wafer 44 are circular in shape and extend to form an annular shaped charge casing 48 about the periphery thereof.

The wafers 42 and 44 are spaced from each other and are retained in a spaced-apart relationship by a pair of securing bolts 50 and 52. The channel 54 between the wafers 42 and 44 communicates with an annular chamber 56 formed in the peripheral shaped charge casing 48. A shamftner orientation of angles 49 in the casing 48 allows to use a wide range of explosives for creating a focused jet upon detonation. The chamber 56 houses the truncated liner 46 that protects an explosive material deposited into the channel 54 and the chamber 56.

The liner 46 has a truncated cross section which facilitates formation of a more efficient, more directed explosive jet on detonation of the explosive. The liner 46 has an inner wall extending at a right angle to the plates 42, 44 and a pair of side walls unitary connected to the inner wall and extending at obtuse angles outwardly therefrom. The wafers 42 and 44 can be made about 3–4 times thinner than plates of a conventional shaped charge apparatus. During tests, a wafer having ⅛" thickness was used with successful results.

The wafers 42, 44 are supported by a rigid frame comprised of a horizontal frame member 60 and a transverse circular frame member 62 that extends about the circumference of the assembly 10 inwardly from the shell 40.

An inflatable bladder 64 is securely attached, such as by bolts 66 to the frame member 62 in a substantially enclosing, covering relationship over the shaped charge liner 46. A gas conduit 68 communicates with a chamber 70 formed between the shaped charge liner 46 and the inner surface of the inflatable bladder 64. The conduit 68 is connected, through a manifold 72, to a gas delivery line 74. The line 74, in turn, is fluidly connected to a source of compressed air 76 (FIG. 1) that is positioned on the deck 18. The source of compressed gas 76 can be a compressed air cylinder provided with a pressure regulator (not shown) set for water pressure at the time of charging, plus 5 PSI.

The gas conduit 68 has an extension 78 that passes through a securing bolt 52 and communicates with the hollow horizontal frame member 60. A gas line formed in the frame member 60 delivers compressed air to lower centralizers 80 telescopically connected to the frame member 60. The lower centralizers 80 are normally retracted, as shown in FIG. 2, into a lower centralizer housing 82 where they are retained in the retracted position by a compression spring (not shown).

When air is delivered through the conduits 74, 68 and 78, the force of the pressurized gas, or air overrides the compression force of the spring and forces the centralizers to extend from the centralizer housings 82 to a position shown in FIG. 3. At that time, the centralizers will contact the interior wall of the tubular member, such as the pile 16, aligning the position of the assembly 10 within the tubular member.

A similar pair of centralizers 84 is secured above the shaped charge plates 42 and 44. The centralizers 84 are telescopically engaged with the respective housings 86 which, in turn, are secured to an upper part of the vertical frame member 62. The centralizer housings 82 and 86 can be secured to their respective support plates 88 and 90, carried by the frame, by suitable engagement means, such as, for example, bolts or screws 92.

The centralizers 84 are normally housed within the housings 86 in a retracted position with the help of compression springs (not shown). A gas conduit 96 connected to the manifold 72 delivers compressed gas, or air to the housings 86, overriding the compression force of the springs and causing the centralizers 84 to extend from the housings 86 and move into a frictional engagement with the inner wall of the pile 16.

The use of the centralizers is desirable when lowering the assembly 10 into the pile 16, since the pile 16 usually extends at an angle to a vertical when supporting an offshore platform. As a result, when the assembly 10 is suspended from a cross member 14, it moves to a side of the pile 16, as shown in FIG. 2, so that the space between the inner wall of the pile 16 and one section of the assembly 10 is less than the remainder of the circumference. When the centralizers are extended, the assembly 10 centralizes itself in the interior of the pile 16, so that an equal stand off distance is formed about the circumference of the shell 40 and of the shaped charge casing 48.

The inflatable bladder 64 is inflated prior to detonation of the explosive charge and assumes an orientation similar to the view shown in FIG. 3. Once the bladder 64 is inflated, a required stand off distance is formed between the liner 46 and the inner wall of the pile 16. This distance is necessary for creation of an effective jet that is formed by the explosion of the material in the shaped charge casing 48.

If desired, an optional auxiliary inflation plug 100 can be provided below the lower wafer 44. The auxiliary plug 100 is adapted for connecting to a gas conduit, similar to the gas conduit 68, and for delivery of compressed gas or air to the inflatable bladder 64, if necessary.

A detonating cord 102 is operationally connected to a detonator 104 positioned on the cross support plate 14 above the water line 20. The detonator 104 is connected to a control device 106 positioned on the deck 18 and adapted to send an electrical signal to the detonator 104 to initiate an explosion. The detonating signal is transmitted through the detonating cord 102 to a central detonating plug 108 which communicates with the explosive material positioned in the space 54.

From the central position of the plug 108, the detonating signal is distributed radially through the space 54 and travels to the chamber 56 where more explosive material is positioned. In response to the signal, an explosion is created, causing expansion of gas behind the truncated shaped liner 46 and carrying particles of the exploded liner 46 radially away from the center of the assembly 10.

The force of the explosion causes severing of the pile 16, or other tubular member within which the assembly 10 is suspended. A relatively even, smooth cut is created, allowing to remove the upper portion of the pile 16, leaving the bottom portion buried below the mudline. The centralizers 80 and 84 can be retracted back into the housings 82 and 86, respectively, by relieving the pressure in the conduits 68 and 96. Once the centralizers are retracted, they retain their position within the housings 82 and 86, allowing the assembly 10 to be retrieved from the surface, if desired. If desired, the source of pressurized gas can be provided with a manifold to allow an independent pressurized gas to the centralizer, 84 and the inflatable bladder 64.

The truncated shaped charge liner 46 allows to use less explosive than is conventionally found necessary for severing a tubular member of a particular thickness. Additionally, the wafers 42 and 44 can be made of a thinner material. Consequently, less weight needs to be lowered into the pile 16, making the severing operation more economical and efficient.

Many changes and modifications to the present invention will become apparent to those skilled in the art. I, therefore, pray that my rights to the present invention be limited only by the scope of the appended claims.

I claim:

1. An apparatus for severing tubular members, comprising:

an outer shell;

an explosive charge carrier mounted in said shell, said carrier comprising a pair of parallel plates, a circular shaped charge casing carried by circumferential edges of said plates, a truncated liner mounted in a spaced-apart relationship to said casing, said liner comprising an inner wall extending in a transverse relationship to said plates and a pair of outwardly inclined side walls, and wherein a chamber for housing an explosive material is formed between said liner and said casing;

a means for lowering said shell and said carrier to a predetermined position within said tubular member; and a means for transmitting a detonation signal to the explosive material for forming a focused jet for severing the tubular member.

2. The apparatus of claim 1, wherein a channel is defined between said pair of parallel plates, said channel communicating with said chamber, and wherein an explosive material is positioned in said channel to facilitate a radial transmission of a detonation signal to explosive material positioned in the chamber.

3. The apparatus of claim 1, further comprising a rigid frame securely attached to said carrier.

4. The apparatus of claim 3, further comprising a means mounted in said shell for centralizing position of said shell within the tubular member.

5. The apparatus of claim 4, wherein said centralizing means comprises a plurality of normally retracted centralizer members carried by said frame, said centralizer members being outwardly extendable from said shell after the shell is lowered to a desired distance within said tubular member.

6. The apparatus of claim 5, further comprising a means carried by the frame for forcing said centralizer members into an extended position.

7. The apparatus of claim 6, wherein said means for forcing the centralizer members into an extended position comprises a conduit means adapted for delivering pressurized gas to said centralizer members, and wherein release of pressure in said conduit means causes the centralizer member to move into a retracted position.

8. The apparatus of claim 3, further comprising a means carried by said frame for forming a predetermined stand off distance between an inner wall of the tubular member and an exterior surface of the liner.

9. The apparatus of claim 8, wherein said means for forming a stand off distance comprises a resilient inflatable bladder fluidly connected to a source of pressurized gas mounted outside of the tubular member, said bladder expanding outwardly from said frame when inflated prior to detonation of the explosive material.

10. The apparatus of claim 2, wherein each of said side walls of the truncated liner is unitary connected to said inner wall and extends at an obtuse angle outwardly therefrom.

11. The apparatus of claim 2, wherein said means for transmitting a detonation signal comprises a detonating plug securely attached to a center of one of said plates and having a detonating cord extending through said plug to the channel between the parallel plates, said detonating cord being connected to a detonation control device mounted outside of a tubular member.

12. An apparatus for severing an underwater tubular member, comprising:

an outer shell;

an explosive charge carrier mounted in said shell, said carrier comprising a pair of parallel plates, a circular shaped charge casing, carried by circumferential edges of said plates, said pair of parallel plates defining a channel therebetween, each of said plates being unitary connected to the casing, a truncated liner mounted in a spaced-apart relationship with said casing, said liner comprising an inner wall extending in a transverse relationship to said plates and a pair of outwardly inclined side walls, and wherein a chamber for housing an explosive material is formed between said liner and said casing;

a means for lowering said shell and said carrier to a predetermined position within said tubular member;

a means mounted in said shell for centralizing position of said shell within the tubular member; and a means for transmitting a detonation signal from an above-the-water location to an explosive material to form a focused explosive jet for severing the tubular member.

13. The apparatus of claim 12, wherein each of said side walls of the truncated liner is unitary connected to said inner wall and extends at an obtuse angle outwardly therefrom.

14. The apparatus of claim 12, wherein a channel is formed between said plates, said channel communicating with the chamber, and wherein an explosive material is positioned in said channel to facilitate a radial transmission of a detonation signal to explosive material positioned in the chamber.

15. The apparatus of claim 12, further comprising a rigid frame securely attached to said carrier.

16. The apparatus of claim 14, wherein said centralizing means comprises a plurality of normally retracted centralizer members carried by the frame, said centralizer members being outwardly extendable from the shell after the shell is lowered to a predetermined distance within the tubular member.

17. The apparatus of claim 16, further comprising a means carried by the frame for forcing the centralizer members into an extended position, said means comprising a conduit means adapted for delivering pressurized gas to the centralizer members, and wherein release of pressure in said conduit means causes the centralizer member to move into a retracted position.

18. The apparatus of claim 16, wherein said centralizer members are positioned above and below said plates in said shell, each of said centralizer members being telescopically engaged within a centralizer housing carried by said frame.

19. The apparatus of claim 12, wherein said shell has a generally oval cross section to facilitate lowering of the shell into a tubular member.

20. The apparatus of claim 14, wherein said means for transmitting a detonation signal comprises a detonating plug securely attached to a center of one of said plates and having a detonating cord extending through said plug to the channel between the parallel plates, said detonating cord being connected to a detonation control device mounted outside of a tubular member.

* * * * *